United States Patent [19]

Bozek

[11] Patent Number: 4,942,861

[45] Date of Patent: Jul. 24, 1990

[54] CROSS BOW WITH IMPROVED COCKING MECHANISM

[76] Inventor: John W. Bozek, 6093 Waterfront Dr., Waterford, Mich. 48095

[21] Appl. No.: 178,763

[22] Filed: Mar. 28, 1988

Related U.S. Application Data

[63] Continuation of Ser. No. 859,698, May 5, 1986, abandoned, which is a continuation-in-part of Ser. No. 778,316, Sep. 20, 1985, Pat. No. 4,649,892.

[51] Int. Cl.[5] ..... F41B 5/00

[52] U.S. Cl. ..... 124/25; 124/35.1

[58] Field of Search ..... 124/25, 35 R, 31, 41 R, 124/27, 26, 22, 21, 83, 84, 20 B, 20 R, 24 R

[56] References Cited

U.S. PATENT DOCUMENTS

| | | | |
|---|---|---|---|
| 2,040,150 | 5/1936 | Merrill | 124/25 X |
| 2,842,114 | 7/1958 | Duncan | 124/25 |
| 3,028,851 | 4/1962 | Drake | 124/25 |
| 3,043,287 | 7/1962 | Nelson | 124/25 |
| 3,538,901 | 11/1970 | Switack | 124/41 R X |
| 3,670,711 | 6/1972 | Firestone | 124/41 R X |
| 3,857,379 | 12/1974 | Burghardt | 124/41 R X |
| 4,041,927 | 8/1977 | Van House | 124/24 R |
| 4,388,914 | 6/1983 | Cesin | 124/25 |
| 4,593,675 | 6/1986 | Waiser | 124/25 |
| 4,594,994 | 6/1986 | Williams | 124/25 |
| 4,697,571 | 10/1987 | Waiser | 124/25 |
| 4,719,897 | 1/1988 | Gaudreau | 124/35 R X |

*Primary Examiner*—Peter M. Cuomo

*Attorney, Agent, or Firm*—John R. Benefiel

[57] ABSTRACT

A cross bow is disclosed which includes a cocking mechanism for moving the drawstring to the drawn position. A cocking lever is pivotally mounted beneath the cross bow stock and an operating cable connected at one end to the cocking lever is pulled by pivoting motion of the cocking lever away from the stock member. The operating cable is connected at its other end to an engagement block movable in a lengthwise track and engages the drawstring either directly or through a slider element also mounted in the track, such as to be slid rearwardly upon pivoting of the cocking lever away from the stock to a cocked position in which it is held by a trigger mechansim. The prod is mounted on a movable slide, which in turn is connected to a cocking lever operated linkage so as to be retracted a lesser distance as the cocking lever is pivoted to draw the drawstring and extended as the cocking lever is pivoted back towards the stock to cause the prod limbs to be bent against the restraint of the trigger mechanism. This reduces the peak drawing effort required to cock the cross bow.

7 Claims, 8 Drawing Sheets

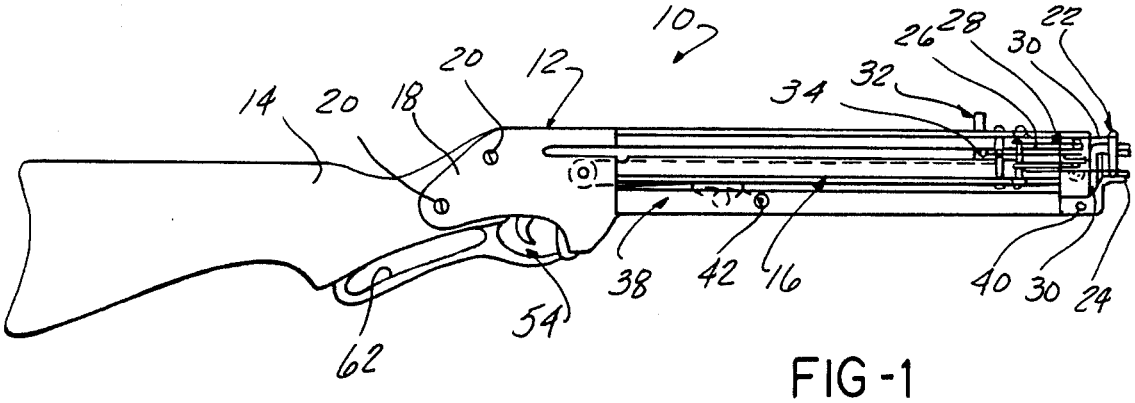
FIG-1
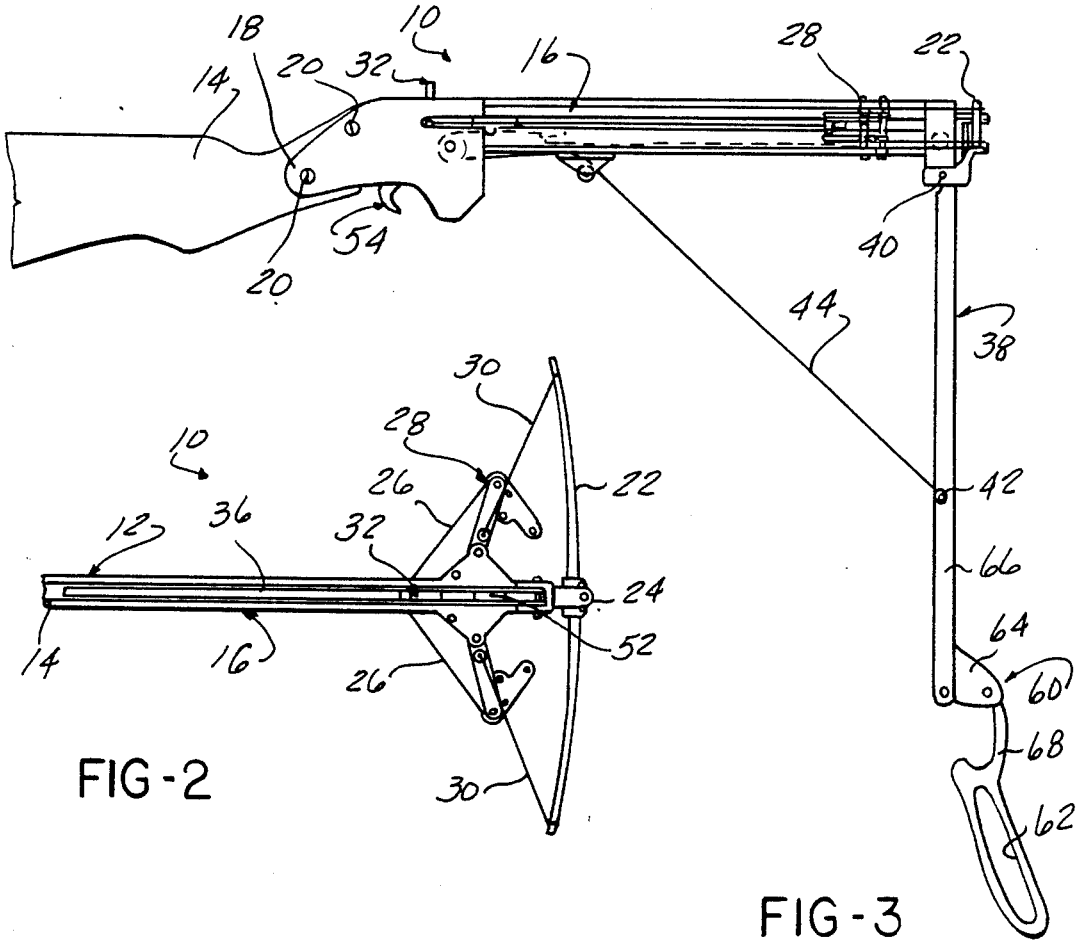
FIG-2
FIG-3

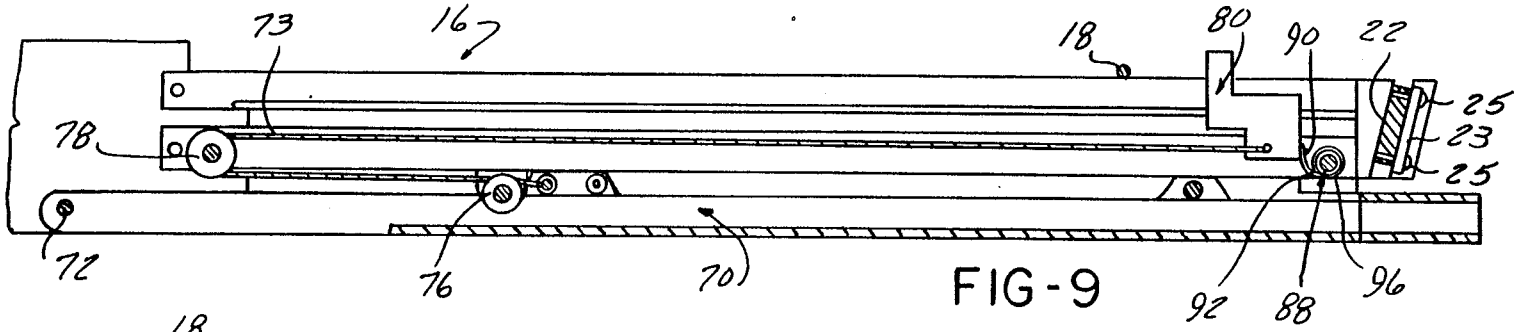
FIG-9
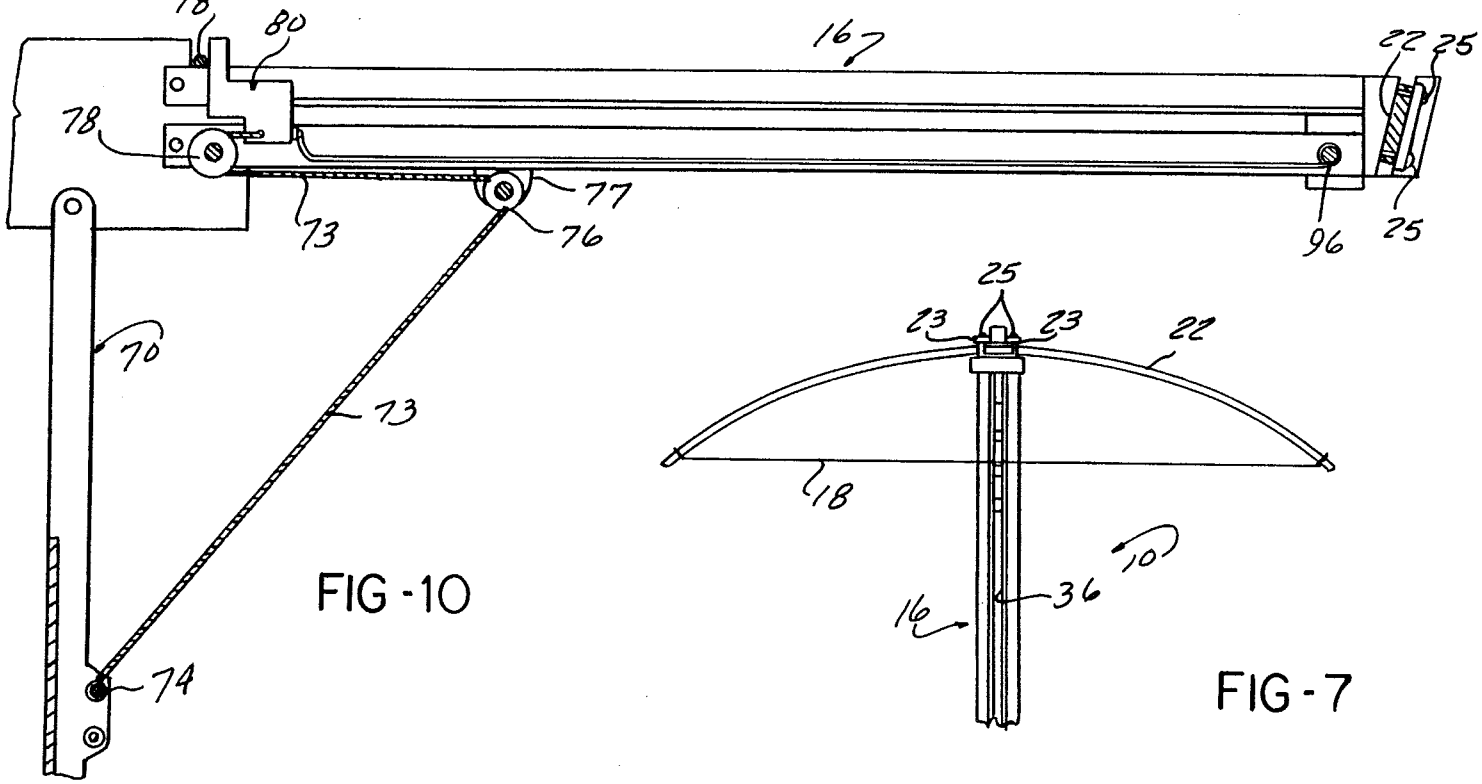
FIG-10
FIG-7

CROSS BOW WITH IMPROVED COCKING MECHANISM

This application is a continuation of application Ser. No. 06/859,698 filed on May 5, 1986, which is a continuation-in-part of application Ser. No. 06/778,316 filed on Sep. 20, 1985, now U.S. Pat. No. 4,649,892.

BACKGROUND OF THE INVENTION

The present invention concerns cross bows, and more particularly, cross bows having cocking mechanisms for drawing the drawstring to a fully tensioned, drawn position.

DESCRIPTION OF THE PRIOR ART

It has heretofore been recognized that it would be advantageous to facilitate the cocking of a cross bow by providing a mechanism for this purpose rather than to rely on manual drawing of the drawstring.

Devices which have been heretofore been provided, however, have been complex, bulky, and cumbersome, such that cocking mechanisms are not commonly employed on cross bows. Examples of such devices are shown in U.S. Pat. No. 3,670,711, U.S. Pat. No. 3,043,287, U.S. Pat. No. 4,258,689. Ease of operation has not been achieved by many of these designs. In U.S. Pat. No. 4,649,892 referenced above, a cross bow is disclosed having a cocking mechanism which is relatively simple and compact, and yet may be easily manipulated with greatly reduced effort by a user.

The cocking mechanism disclosed therein requires an extensive range of pivoting motion of a cocking lever to draw the drawstring to the cocked position. The extent of motion required is a disadvantage as making cocking slower and more cumbersome than if a more compact motion could be employed and also precludes the application of leveraging to reduce the effort required in bending the limbs of the cross bow prod as the drawstring is moved to the fully drawn position.

It is the object of the present invention to provide an improvement over the cocking mechanism disclosed in U.S. Pat. No. 4,649,892 by reducing the required range of motion of the cocking lever in drawing the drawstring and also to allow a leveraging to be applied to reduce the maximum effort required to draw the cross bow.

SUMMARY OF THE INVENTION

This and other objects of the present invention which will become apparent upon a reading of the following specifications and claims are achieved by a cross bow cocking mechanism consisting of an elongated cocking lever, pivotally mounted to the cross bow stock member, such as to be moved from a position extending along and beneath the stock member to a pivoted position, down and away therefrom.

An operating cable is provided, which is connected at one end to an intermediate point on the cocking lever, and is pulled by pivoting motion of the cocking lever. The operating cable passes about a series of guide pulleys, such as to extend lengthwise along the stock member and is attached to an engagement block slidably movable in a lengthwise track formed along the length of the stock member frame. The engagement block is movable into engagement with of the drawstring, such that upon pulling of the engagement block the drawstring is moved rearwardly when the cocking lever is pivoted away from the stock member.

Retraction means is also provided, consisting of a wind-up spring having an extensible flexible strip attached to the opposite side of the engagement block, such as to be extended upon cocking motion, and thereafter retracting upon movement of the cocking lever to its initial position. In alternate disclosed embodiments, the cocking lever is pivoted either at its forward or its rear end.

The improvement of the present invention comprises the mounting of the cross bow prod on a slide, moveable in and out from the forward end of the cross bow stock. The slide in turn is operated by a linkage system which retracts the slide and prod as the cocking lever is pivoted away from the stock and the drawstring is drawn to reduce the bending of the prod limbs and the maximum effort required. The point of connection of the cable to the slide is such as to minimize the range of pivoting motion required to fully retract the drawstring.

The linkage moves overcenter as the cocking lever returns to its normal position, such that the reaction force developed by the bending of the prod is exerted to maintain the cocking lever in its usual rest position.

DESCRIPTION OF THE DRAWINGS

FIG. 1 is a side elevational view of a cross bow incorporating a cocking mechanism of which the present invention is an improvement.

FIG. 2 is a fragmentary plan view of the front portion of the cross bow shown in FIG. 1.

FIG. 3 is a side elevational view of the cross bow shown in FIG. 1, with the cocking mechanism fully extended.

FIG. 7 is a fragmentary plan view of the front portion of the cross bow shown in FIG. 6.

FIG. 9 is a fragmentary enlarged sectional view of the cross bow shown in FIG. 6, depicting the details of the cocking mechanism in the return position.

FIG. 10 is an enlarged fragmentary sectional view of the cross bow shown in FIG. 8, showing the details of the cocking mechanism, with the cocking mechanism in the extended position.

DETAILED DESCRIPTION

Figure 4:
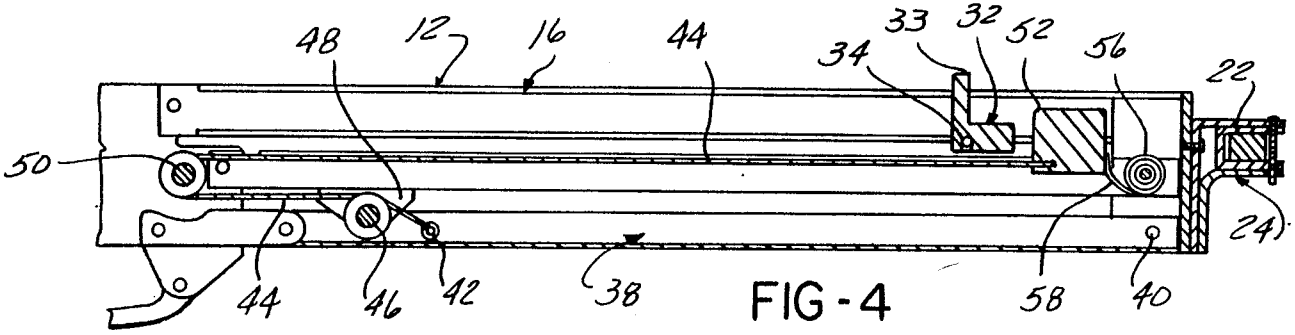
FIG. 4 is an enlarged fragmentary sectional view of a portion of the cross bow shown in FIG. 1.

In the following detailed description, certain specific terminology will be employed for the sake of clarity and a particular embodiment described in accordance with the requirements of 35 USC 112, but it is to be understood that the same is not intended to be limiting and should not be so construed inasmuch as the invention is capable of taking many forms and variations within the scope of the appended claims.

In co-pending application Attorney Docket Number BOZ-102, Ser. No. 778,405 filed on Sept. 20, 1985, now U.S. Pat. No. 4,649,892 there is disclosed a cross bow according to the configuration shown in FIGS. 1 and 2, in which the details thereof are set forth. Inasmuch as the present invention is directed to the cocking mechanism, the details of construction will not be hereinafter set forth for the sake of brevity.

The present invention as noted above comprises an improvement of the cocking mechanisms disclosed in Ser. No. 778,316 filed on Sept. 20, 1985 now U.S. Pat. No. 4,649,892. In order that this improvement can be understood, the aforementioned previously disclosed cocking mechanisms will also be described in FIGS. 1–10 herein prior to describing the improvement of the present invention.

Referring to the drawings, and particularly to FIGS. 1 and 2, a cross bow 10 includes an elongated stock member 12 including a butt portion 14, adapted to be positioned against the shoulder of the user, and a stock member frame 16 attached thereto with metal plates 18, forming a part of frame 16 and screws 20.

At the forward end of the stock member 12, is fixed a transversely extending prod 22 of suitable flexible, resilient material and is pivotally attached at its midpoint to the stock member frame 16.

The prod 22 is connected to the forward end of the stock member frame 16 by means of a clevis 24, which as to be pivotally mounted so as to be readily detachable to the stock member frame 16, as described in the referenced patent application in detail.

The prod 22 is adapted to be flexed by drawing of a central nocking point of drawstring 26 towards the rear of the stock member 12 to constitute a spring means generating a spring force increased with drawing of the drawstring 26 acting to urge the nocking point to its restored position. For this purpose, an interconnection between the drawstring 26 segments lying on either side of the stock member 12, and the tips of the prod 22 is provided. As described in detail in the aforementioned application Ser. No. 778,405, the interconnection comprises variable leverage devices 28 which by means of load cables 30 attached to each prod tip 22 causes flexing movement of the prod 22 upon motion of the nocking point of the drawstring 26, aligned with nocking point located at the point the drawstring 26 passes across the stock member 12.

The variable leverage devices 28 function to produce a variation in the force required in moving the drawstring 26 to the rear with increasing draw distance. As described in the aforementioned application Ser. No. 778,405 in detail, it is important to constrain the side-to-side movement of the drawstring 26 with respect to the stock frame 16. Accordingly, a slider element 32 is provided, secured by means of bead fasteners 34, to the central point of the drawstring 26, preventing side-to-side movement relative the element 32.

A slider element 32 is itself in turn constrained to move in a lengthwise slot, comprising a track means 36, formed in the stock member frame 16 for the purposes described in the above referenced application; and includes a projection 33 adapted to engage a arrow or bolt to be launched.

The cocking mechanism according to the present invention includes an elongated cocking lever 38, pivotally mounted at 40 at its forward end to the front end of the stock member 12 and is adapted to be pivoted in forward and return movement from an initial position lying alongside and beneath stock member 12, as shown in FIG. 1, to an extended position pivoted down and away therefrom, as shown in FIG. 3.

Attached at a point intermediate the length thereof, is one end of an operating cable 44 which is attached to cocking lever 38 at 42 so as to be drivingly connected so as to be pulled by the pivoting motion of the cocking lever 38, moving about its pivot mount 40.

Figure 5:
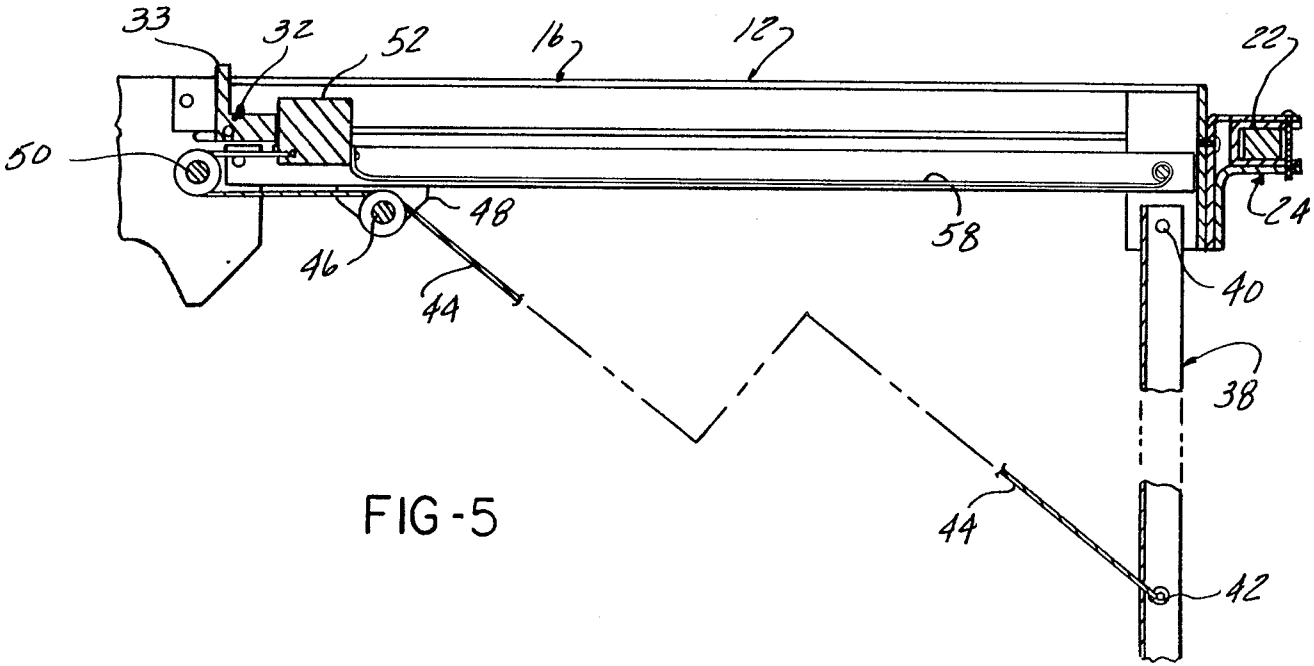
FIG. 5 is an enlarged fragmentary sectional view of a cross bow section as shown in FIG. 2, with the cocking mechanism in the extended position.

Operating cable 44 is directed by means of guiding means as best seen in FIGS. 4 and 5, and comprises a first pulley 46 located intermediate the length of the stock member 12, mounted by means of a bracket 48 secured to the underside of the stock member frame 16, and also located intermediate the length of the cocking lever 38. The guide means also includes a second pulley 50 spaced to the rear of first pulley 46 with the operating cable 44 passing above the first pulley 46 and around the second pulley 50, such as to extend lengthwise and forwardly through the stock member frame 12.

At the forward end of the stock member frame 16, the operating cable 44 is attached to an engagement block 52, also slidably mounted within the track 36 located forwardly of the slider element 32, so as to be engageable therewith upon pulling motion of the operatng cable 44.

The engagement block 52 thus is able to come into contact with the slider element 32 as block 52 moves to the rear and the operating lever 38 is pivoted away from the stock member frame 16, as shown in FIG. 5, such as to cause slider element 32 to also be moved to the rear.

A suitable trigger mechanism 54, the details of which are not shown herein, serves to engage the slider element 32 and restrain it in the retracted or drawn position for selective release in conventional fashion.

In order to provide for return movement of the engagement block 52, a retraction means is provided, comprised of a wind up coil spring 56 mounted at the forward end of the stock member frame 12 including an extensible spring strip 58 attached to the forward end of the engagement block 52. As the engagement block 52 moves to the rear, the extensible spring strip 58 unwinds from the wind-up coil 56, but acts to urge the block 52 to the return, forward position.

The cocking lever 38 is formed with a handle portion 60, which includes a finger loop 62 able to be conveniently gripped by the user in order to accomplish the cocking motion with a bracket 64, securing the same to the strut 66, forming the main body of the cocking lever 38. Adjacent the finger loop 62 is a trigger guard 68 adapted to surround the trigger of the trigger mechanism 54, thus creating the familiar lever action appearance to the cross bow.

Accordingly, it can be seen that a relatively simple, yet effective cocking mechanism is provided which is also compact and able to be housed easily within the normal lines of the conventional cross bow, and which is advantageously combined with the constrained drawstring slider design according to the aforementioned co-pending patent application Ser. No. 778,405.

Referring to FIGS. 6–10, an alternate arrangement is shown, in which a cocking mechanism is incorporated in a conventional cross bow design. The cross bow 10, in this instance, similarly includes a stock member 12 including a butt portion 14 and a stock member frame 16, connected by plates 18 and screws 20.

The prod 22 is rigidly affixed at the forward end mounted by any conventional means such as by clamping plates 23 which are attached by bolts 25.

The drawstring 26 is held in the drawn retractive position by a trigger mechanism 54, and selectively released for firing a bolt, (not shown) in the manner generally well known in the art.

Figure 6:
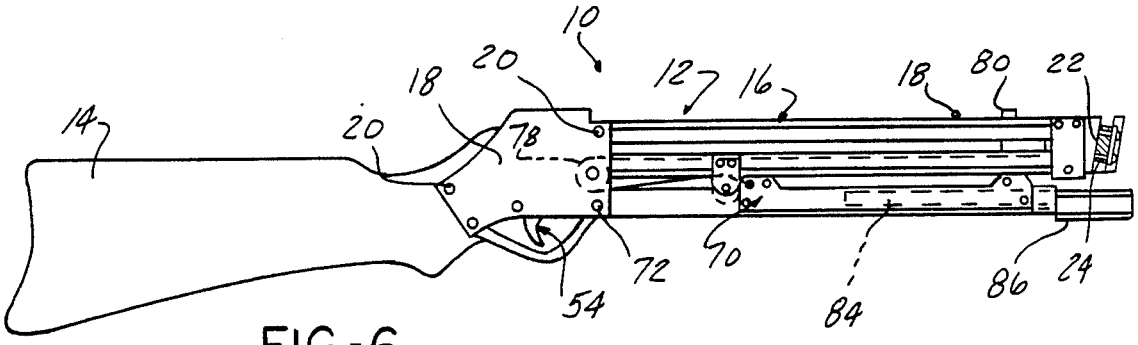
FIG. 6 is a side elevational view of a cross bow incorporating a cocking mechanism according to a second embodiment of which the present invention is an improvement, with the cocking mechanism in the return or normal position.
Figure 8:
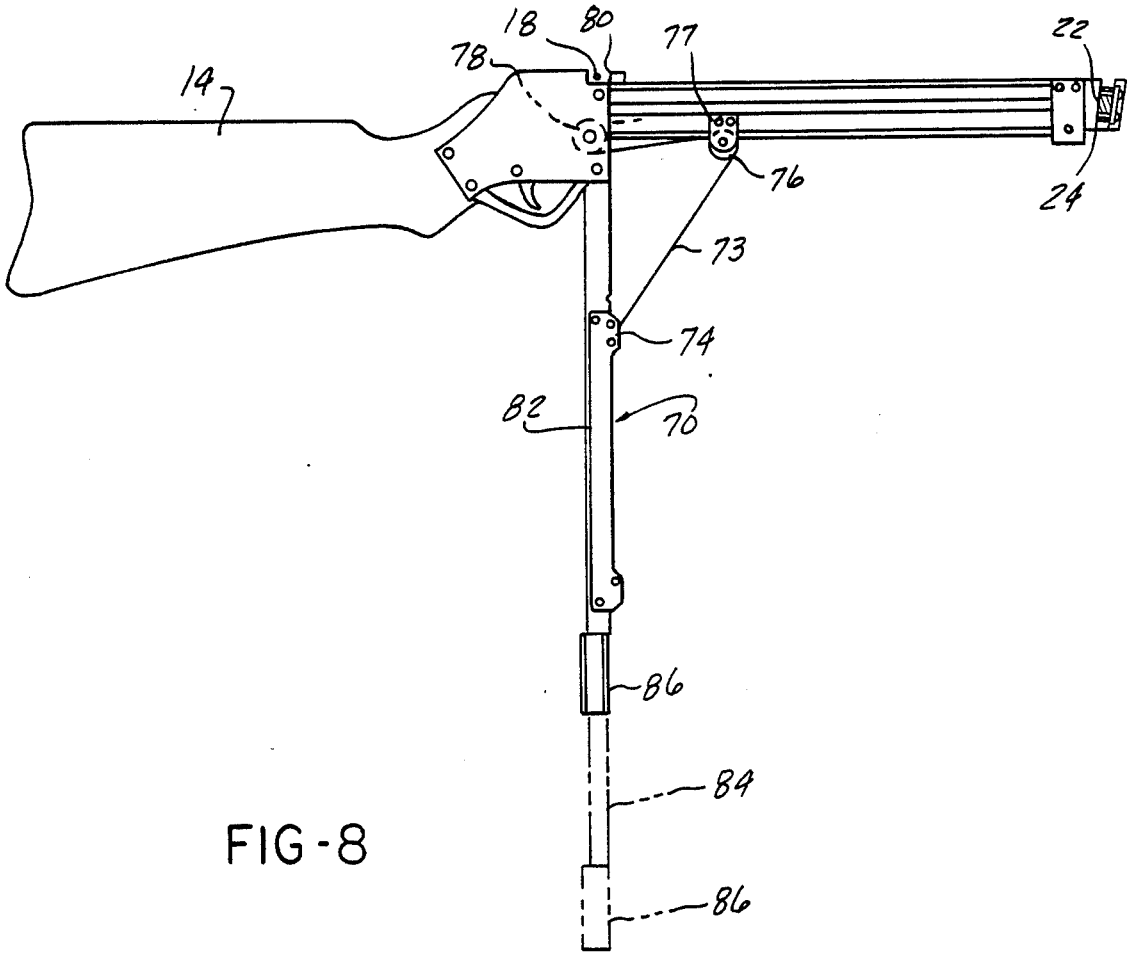
FIG. 8 is a side elevational view of the cross bow shown in FIG. 6 with the cocking mechanism in the fully extended position.

In this embodiment, a cocking lever 70 is provided which is pivoted at its rear end 72 to the stock member frame 16, such as to swing in a opposite sense from the above described embodiment, from a position underlying the stock member frame 16, as shown in FIG. 6 to a down and away position shown in FIG. 8. This pivoting motion accomplishes the drawing of the drawstring 18 to the fully drawn position.

This is also achieved by means of an operating cable 73 which is connected at one end at 74, to an intermediate point along the length of the cocking lever 70, such as to be pulled by the pivoting motion of the cocking lever 70 in moving away from the stock member 12.

Operating cable 73 passes around a first pulley 76 to a second pulley 78 spaced to the rear such that the operating cable may pass around to extend forwardly within the stock member frame 16 and be connected to the engagement block 80 as in the above described embodiment. The engagement block 80 is also slidably mounted in the track 36 slidably receiving the slider element 32.

Thus, the operating cable 73 pulls the engagement block 80 rearwardly to draw the drawstring to the rear to the fully drawn position shown in FIGS. 8 and 10. The trigger mechanism 54 is engageable therewith to hold the same in the fully retracted position, allowing return of the cocking lever 70.

Cocking lever 70 in this embodiment, is of two piece construction and includes members 82 and 84, 84 having a handle 86 affixed thereto and adapted to be slidably engaged such that member 84 may be extended therefrom to increase the length of the cocking member 70 and increase the leverage able to be exerted thereby.

A retracting wind up coil spring 88 is also included having extensible strip 92 connected at 90 to the forward end of the engagement block 80. The retracting coil spring 88 is able to be unwound upon rearward travel of the engagement block 80, in the position as shown in FIG. 10 and upon release thereof rewound about a spring axle 96.

In FIGS. 11–16 there is shown the improved cocking mechanism for the embodiment of FIGS. 1–6 shown above, in which the same construction is employed for the components of the cross bow 10 other than the cocking mechanism.

Figure 12:
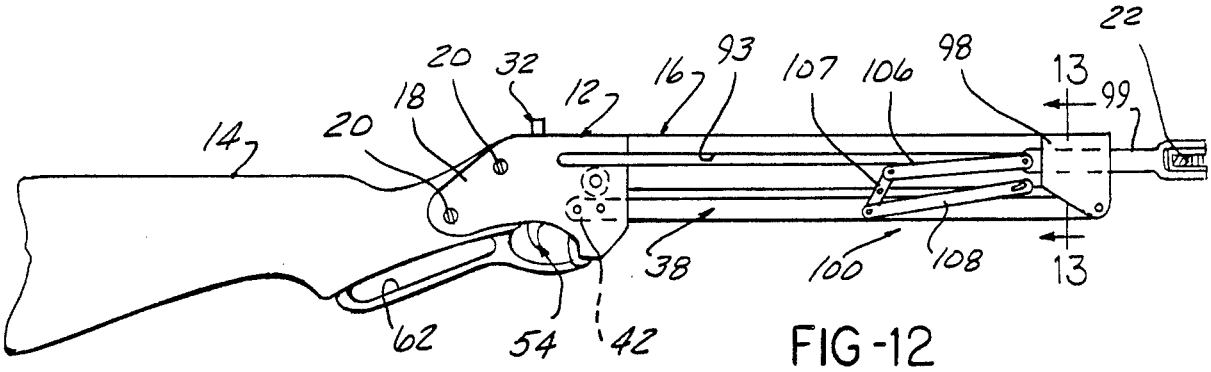
FIG. 12 is a side elevational view of a cross bow of the type shown in FIGS. 1–5 incorporating an improved cocking mechanism according to the present invention, shown in the cocked condition.
Figure 11:
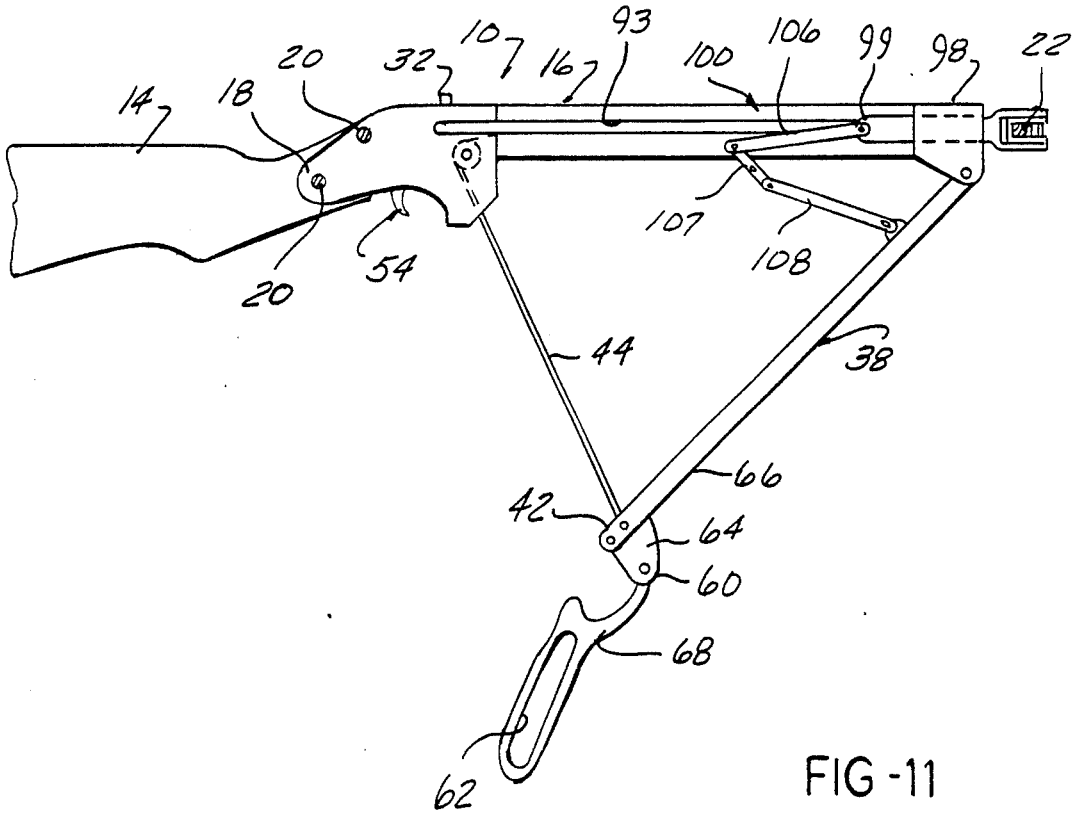
FIG. 11 is a side elevational view of the cross bow of the type shown in FIGS. 1–5 incorporating an improved cocking mechanism according to the present invention, depicting the cocking operation partially completed.
Figure 18:
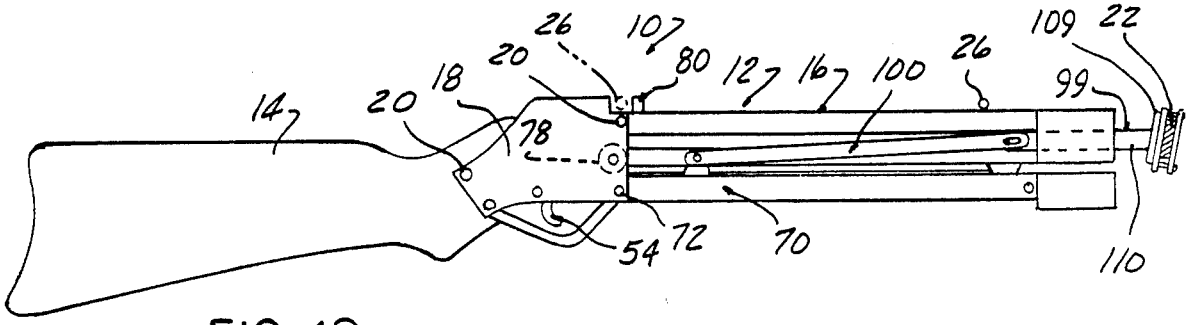
FIG. 18 is a side elevational view of a cross bow of the type shown in FIG. 6–10 with the improved cocking mechanism according to the present invention, depicted in the cocked condition.
Figure 17:
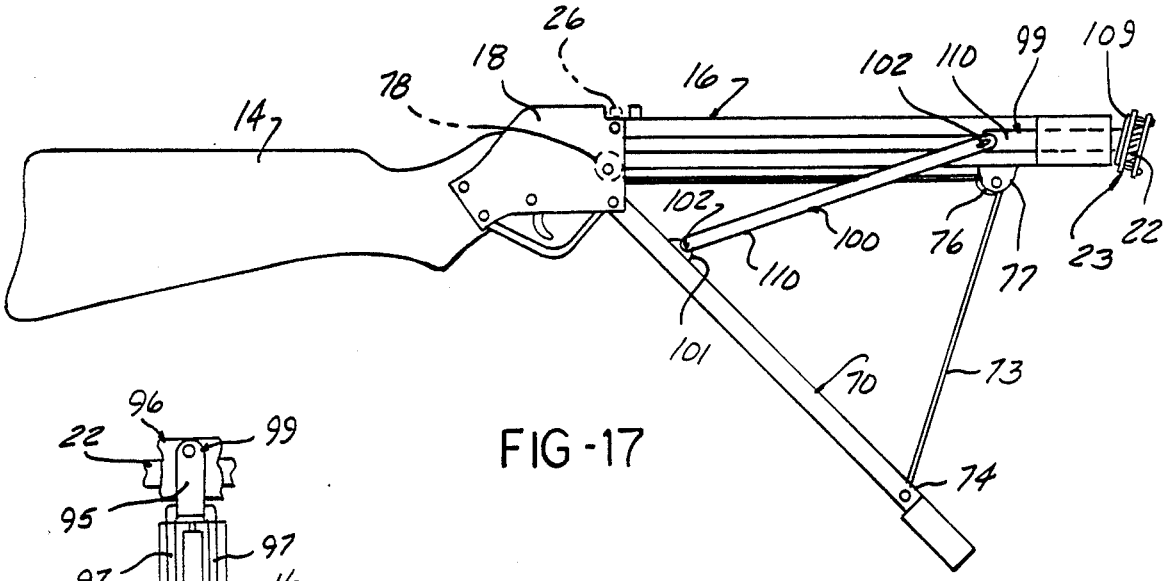
FIG. 17 is a side elevational view of the type of cross bow shown in FIGS. 6–10, depicted in the partially cocked condition.
Figure 14:
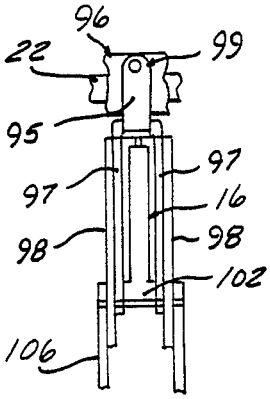
FIG. 14 is a plan fragmantery view of the portion of the cross bow shown in FIG. 11.

Referring to FIGS. 11 and 12, according to the concept of the present invention, the prod 22 is mounted to be movable in and out from the front end of the frame 16 so as to be drawn towards the frame 16 as the cocking lever 38 is pivoted away from the frame 16, as shown in FIG. 11; and, to be moved out as the cocking lever 38 is pivoted towards the frame 16 as shown in FIG. 12.

Thus as the cable 44 is drawn to pull the slide element 32 and drawstring 36 to the rear, the prod 22 also is moved to the rear but a lesser distance to negate in part the bending of the limbs of the prod 22. Hence, full bending thereof will not occur until the prod 22 is moved out upon return pivoting movement of the cocking lever 38.

This greatly reduces the peak effort required to move the drawstring 26 to the cock position so that the cable 44 may be attached at 42 at a point further out on the cocking lever 38 to maximize travel of the slider block 32 resulting from pivoting of the cocking lever 38, to minimize the range of travel of the cocking lever 38 required thereby to carry out the cocking action.

Figure 13:
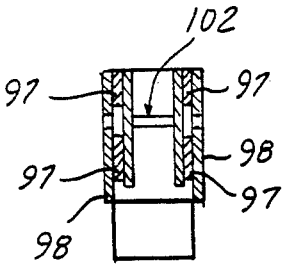
FIG. 13 is a view of the section 13—13 taken in FIG. 11.
Figure 19:
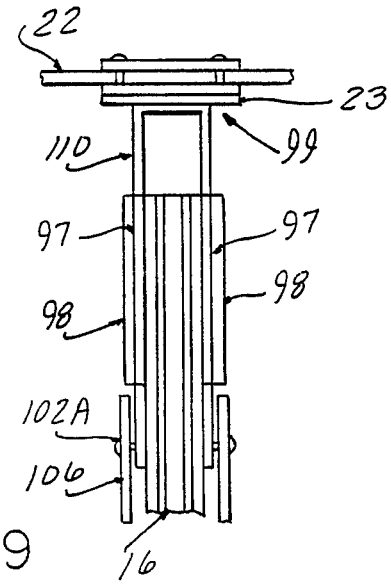
FIG. 19 is a fragmentary plan view of the front portion of the cross bow shown in FIGS. 17 and 18.

The retraction-extension of the prod 22 produced by linkage means 100 drivingly connecting the cocking lever 38 and a prod slide 99. The prod slide 99, as seen in FIG. 13 is a double fork shaped element, having a forward fork 95 receiving a prod clevis 96 and forward fork 95 together.

A rear fork 94 of the prod slide 99 is slidably mounted between two side plates 98 attached at the forward end of the frame 16, with upper and lower spacer plates attached to the inside thereof (FIGS. 13, 14) establishing guide means acting on the prod slide 99 to guide the same through its in and out movement. Cocking lever 38 is pinned at 40 to the side plates 98 for pivoting movement.

Linkage means 100 provides a mechanical advantage in the leveraging applied as the cocking lever 38 moves to the normal position against frame 16 acting on the prod slide 99 to force the same outwardly, such that the peak effort required to overcome the resistance of the prod 22 is greatly reduced.

Figure 16:
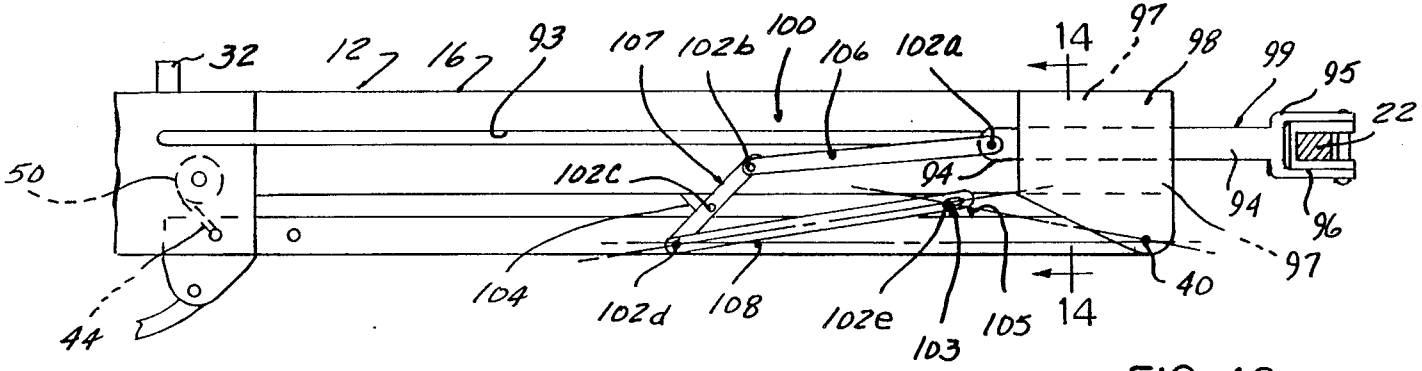
FIG. 16 is a fragmentary enlarged side view of the cross bow as shown in FIG. 12.
Figure 15:
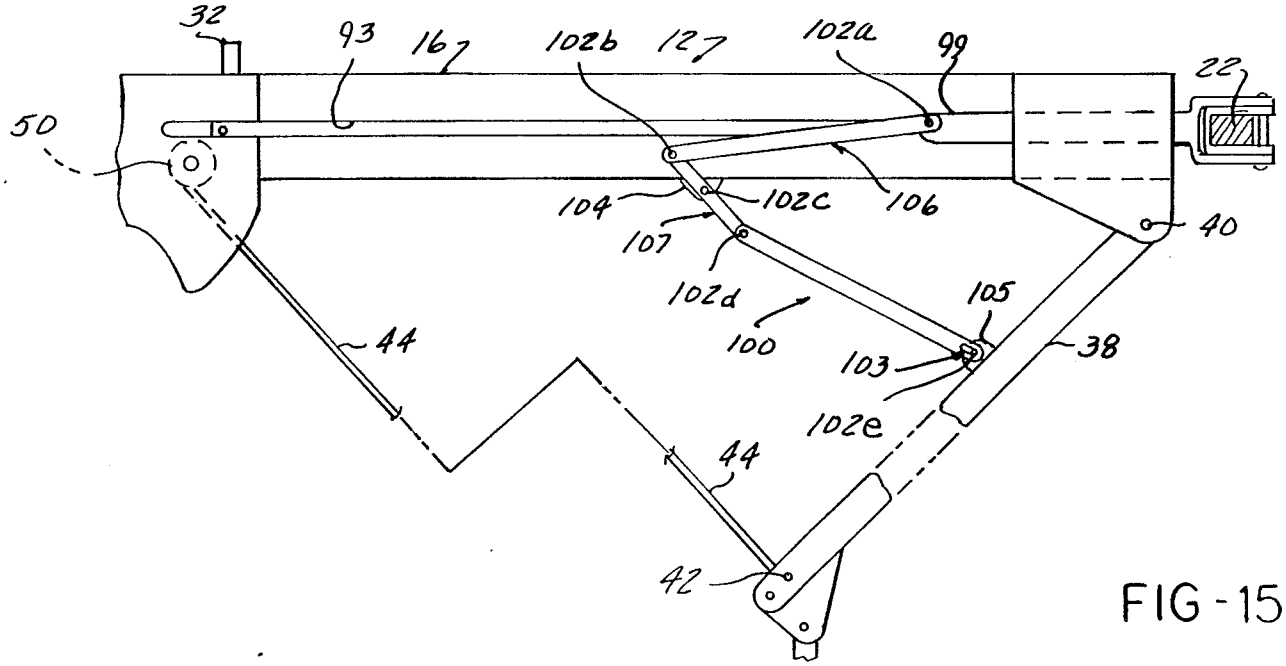
FIG. 15 is a fragmentary enlarged side view of the cross bow as shown in FIG. 11.
Figure 21:
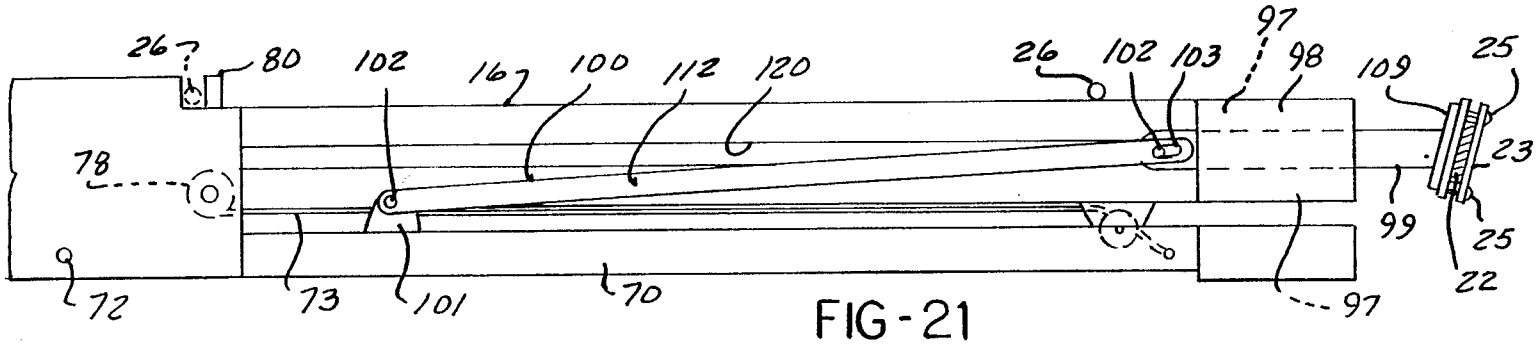
FIG. 21 is an enlarged fragmentary side elevational view of the cross bow as shown in FIG. 18.
Figure 20:
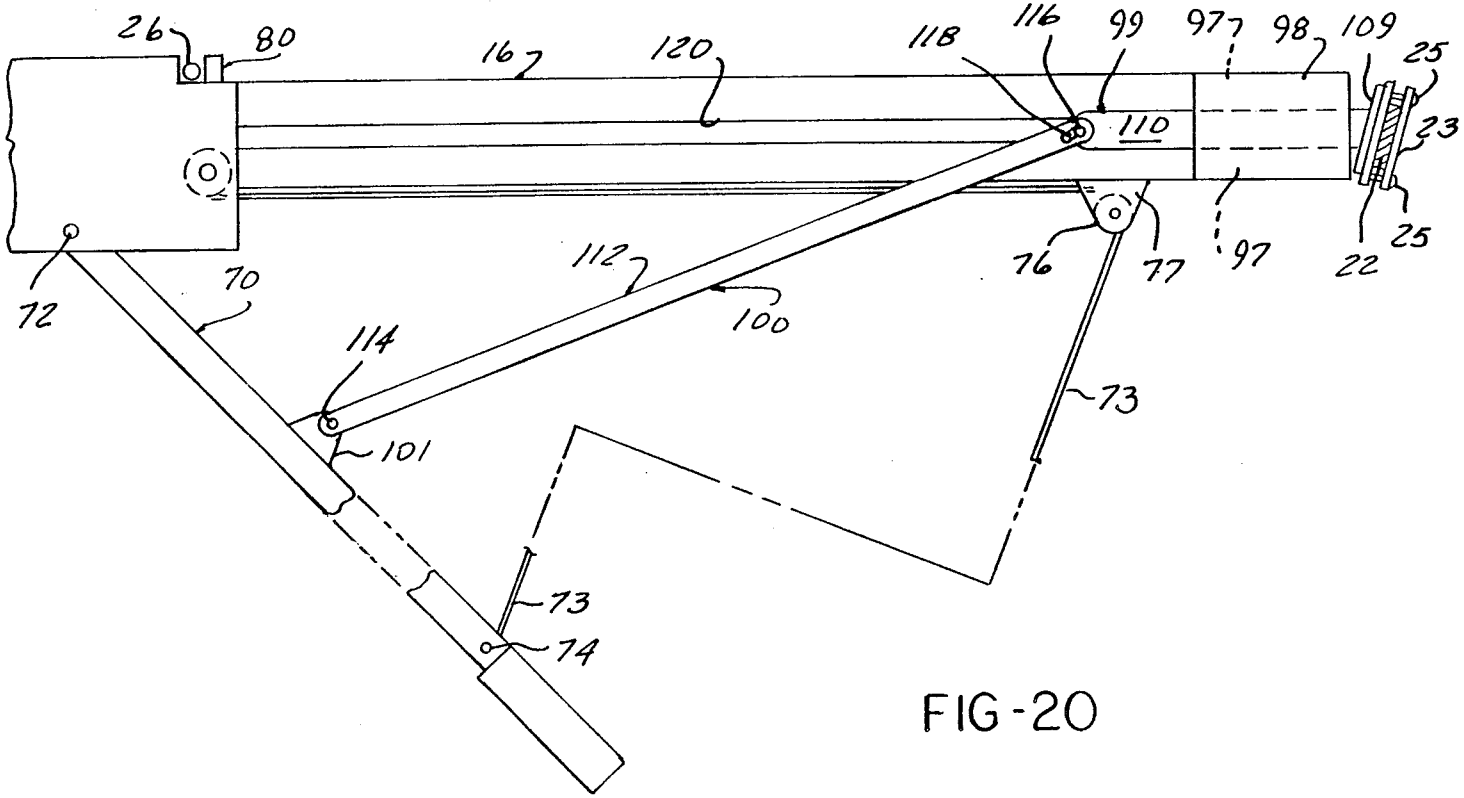
FIG. 20 is an enlarged fragmentary side elevational view of the cross bow as shown in FIG. 17.

As seen in FIGS. 15 and 16, linkage means 100 includes a series of interconnected link pairs, including prod slide limb pair 106, which has one end pinned at **102*a* to the rear fork 94 of the prod slide 99 and at the other end to fulcum lever pair 107. Fulcum lever pair 107 is centrally pivoted at 102*c* on a pivot block 104 affixed beneath frame 16, and at its other end pivoted at 102*d* to a cocking lever link pair 108. Link pair 108 has its other end at 102*e* pinnned to a pivot block 105 fixed to the cocking lever 38. An elongated slot 103 allows limited lost motion of each link in link pair 108, so that as the cable 44 is pulled and prod link 99 moves to the rear, the cocking lever 38 may be pivoted slightly past the fully retracted position of the prod link 99 and ensure that slide 32** is cocked by being engaged with the trigger mechanism.

As the cocking lever 38 pivots back a powerful leverage is exerted by the cocking lever, particularly since the pivot 105 is located relatively close to the pivot point 40.

This leverage increases greatly as the cocking lever 38 approaches the frame 16 due to the toggle effect achieved as lever pair 108 approaches alignment with the cocking lever 38.

During the final pivotal movement the lever pair 108 moves overcenter, as indicated by the centerlines in FIG. 16, such that the reaction force exerted by the prod 22 and through the linkage means 100, acts so as to urge the cocking lever 38 towards the rest position shown in FIG. 16. Thus, the cocking lever 38 is stabilized in that position.

This improvement may also be adapted to the cross bow shown in FIGS. 6–10, and this adaption is shown in FIGS. 17–21.

Referring to FIGS. 17 and 18, again, the prod 22 is mounted to be movable in-and-out from the front end of the frame 16 by means of a prod slide 99 slidably moved on the frame 16.

The prod slide 99 includes a front mounting plate 109 affixed to prod mounting bracket 23. The slide 99 includes a fork 110 (FIG. 19) the legs of which received between pairs of spacer plates 97 affixed to the front end of the frame 16 and cover plates 98 to be guided in its in-and-out motion.

Linkage means 100 are provided drivingly connecting the cocking lever 70 and the prod slide 99 so as to move the prod 22 rearwardly as the drawstring 26 is drawn rearwardly by the motion of cable 73 and slide block 80; and to move the prod 22 forwardly the cocking lever 70 is moved back towards the normal rest position.

In this case, the linkage means 100 takes the form of a single link pair 112 pivoted with cross pin 114 to a pivot block 101 fastened to cocking lever 70. Link pair 112 is pivoted to fork 110 by cross pin 116, passing through elongated slot 118 and lengthwise slot 120 in frame 16.

Cable 73 is connected at the extreme end of cocking lever 70 to produce maximum cable travel to minimize the rotation required to cock the drawstring 26.

Elongated slot 118 ensures sufficient travel of the cocking lever 70 to complete the cocking action as the prod slide 99 moves to its inmost position.

Link pair 112 is connected at a point on the cocking lever 70 towards the pivot point 72 to create a powerful leverage action on the prod slide 99 as the cocking lever is moved to its rest poisition. A toggle action is effected as link pair 112 approaches alingment with cocking lever 70 to greatly reduce the maximum effort required to move the prod slide 99 out to bend the prod limbs against the resistence of the restrained drawstring 26.

As the link pair 112 moves to the rest position, it moves overcenter with respect to the pivot axis 72 such that the reaction force exerted by the prod limbs through link pair 112 acts to urge the cocking lever 70 towards the rest position.

Accordingly, it can be appreciated that the improved cocking mechanism results in a substantially reduced cocking motion, and at the same time reduces the maximum effort required. This is accomplished with a relatively simple mechanism.

I claim:

1. A cross bow comprising; an elongated stock member having a forward end and a rear end; a drawstring means having end string segments and a drawstring means midportion connected to said end string segments, said drawstring means extending transversely to said stock member with the drawstring means midportion thereof located at the stock member able to undergo drawing movement; spring means for generating a spring force acting on said drawstring means midportion, said spring force increasing with increasing drawing movement thereof so as to urge said drawstring means midportion to a restored position, said spring force reaching a predetermined peak level at a fully drawn position of said drawstring;

trigger means carried on said stock member adjacent the rear end thereof for releasably securing said midportion of said drawstring means in a fully drawn position;

cocking means comprising a cocking lever mounted on said stock member and means causing said cocking lever to act on said spring means upon movement thereof in forward and return movements in opposite direction, movement of said cocking lever in said forward direction acting on said drawstring to draw said drawstring means midportion to said fully drawn position, and simultaneously acting on said spring means to at least partially nullify the generation of said spring force when said drawstring means midportion is fully drawn, by reducing the level at which said spring force otherwise peaks, and upon return movement said means causing said cocking lever to act on said spring means to generate said spring force at said peak level with the aid of a mechanical advantage, whereby reducing the effort otherwise required in drawing the drawstring means midportion to the fully drawn position.

2. The crossbow according to claim 1 wherein said spring means comprising an elongated flexible prod member having opposite ends and a midpoint, mounted at its midpoint to the forward end of said stock member and having a respective one of said drawstring string segments attached to a respective one of said prod ends, and wherein said cocking lever is drivingly connected to said prod by means operative to move said prod towards or away from said trigger means a lesser distance than the drawing movement of said drawstring means midportion to cause a partial reduction of the generation of spring force otherwise produced by drawing of said drawstring means midportion.

3. In a cross bow for projecting bolts, said cross bow of the type including an elongated stock member, an elongated prod having opposite tips, said prod mounted transversely at a forward end of said stock member with said tips on either side thereof, a drawstring extending between the tips of said prod and across said stock member, and a trigger mechanism mounted to said stock member to the rear of said prod, said trigger mechanism including means for releasably holding a central nocking point of said drawstring in a drawn position with said prod flexed, said cross bow further including a cocking mechanism for moving said drawstring to said drawn position, said cocking mechanism including an elongated cocking lever having a forward and a rear end, said cocking lever pivotally mounted at one end thereof to said stock member to be movable from a rest position lying along said stock member to a position rotated away therefrom, an operating cable attached at one end to said cocking lever so as to be pulled by said pivoting movement of said cocking lever away from said stock member, track means extending along said stock member; and engagement block mounted in said track means for movement therealong, located between said drawstring and said prod to be engageable with said nocking point of said drawstring; said operating cable connected at the other end to said engagement block; and operating cable guide means aligning said operating cable with said track means to cause said engagement block to be pulled rearwardly by said pivoting movement of said cocking lever to draw said nocking point rearwardly, the improvement comprising:

prod slide means on said stock member mounting said prod for movement along the axis of said stock member in a direction towards and away from said trigger mechanism;

linkage means drivingly connecting said cocking lever and said prod slide means causing said prod and said prod slide means to be moved inwardly simultaneously with drawing of said nocking point as said cocking lever is pivoted away from said rest position, said prod being moved thereby a distance substantially less than the distance said engagement block is moved by pivoting movement of said lever, said linkage means causing said prod and said prod slide means to also be moved outwardly as said cocking lever is pivoted to return after said drawstring is drawn.

4. The cross bow according to claim 3 wherein said cocking lever is pivotally attached to its forward end to the forward end of said stock member to pivot beneath said stock member and said linkage means includes a first elongated lever means pivotably connected at one end to an end of said prod slide means; at the one end to the other end of the first lever means; a pivot block fixed to said stock member and pivotally connected to the midpoint of said first elongated lever means; and a second elongated lever means pivotally connected at one end to the other end of said first elongated lever means and pivotally connected at the other end to an intermediate point on said cocking lever.

5. The cross bow according to claim 3 wherein said cocking lever is pivotally mounted at its rear end to said stock member, and said linkage means comprises an elongated lever means pivotally connected at one end to said prod slide means and at the other end to an intermediate point on said cocking lever.

6. The cross bow according to claim 3 wherein said linkage means includes lever means moving overcenter as said cocking lever moves to the rest position acting to urge said cocking lever towards said rest position.

7. The cross bow according to claim 3 wherein said linkage means includes lever means pivotally connected to said cocking lever and drivingly connected to said prod slide means, said lever means approaching alignment with said cocking lever as said cocking lever approaches said rest position whereby a toggle leverage effect is exerted on said prod slide by said cocking lever.

* * * * *